US008087966B2

(12) United States Patent
Hebbinghaus et al.

(10) Patent No.: US 8,087,966 B2
(45) Date of Patent: Jan. 3, 2012

(54) METHOD FOR THE THERMAL TREATMENT OF TUNGSTEN ELECTRODES FREE FROM THORIUM OXIDE FOR HIGH-PRESSURE DISCHARGE LAMPS

(75) Inventors: Gerhard Hebbinghaus, Jülich (DE); Jozef Merx, Vaals (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 802 days.

(21) Appl. No.: 11/568,037

(22) PCT Filed: Apr. 15, 2005

(86) PCT No.: PCT/IB2005/051241

§ 371 (c)(1), (2), (4) Date: May 19, 2009

(87) PCT Pub. No.: WO2005/104165

PCT Pub. Date: Nov. 3, 2005

(65) Prior Publication Data

US 2009/0302764 A1 Dec. 10, 2009

(30) Foreign Application Priority Data

Apr. 21, 2004 (EP) ..... 04101645

(51) Int. Cl.
*H01J 9/14* (2006.01)
*H01J 17/04* (2006.01)

(52) U.S. Cl. ..... 445/49; 445/50; 313/631; 313/633

(58) Field of Classification Search ..... 313/633, 313/630, 574, 575; 445/49, 50
See application file for complete search history.

(56) References Cited

U.S. PATENT DOCUMENTS

| | | | | |
|---|---|---|---|---|
| 2,855,264 | A | 10/1958 | Delrieu | |
| 5,125,964 | A * | 6/1992 | Buerkel et al. | 75/366 |
| 5,530,317 | A * | 6/1996 | Willemsen et al. | 313/633 |
| 6,109,995 | A | 8/2000 | Altmann et al. | |
| 6,626,725 | B1 * | 9/2003 | Bell | 445/35 |
| 7,528,549 | B2 * | 5/2009 | Almanstotter et al. | 313/633 |
| 2003/0211238 | A1 * | 11/2003 | Lee et al. | 427/180 |
| 2007/0182332 | A1 * | 8/2007 | Haacke et al. | 313/633 |

FOREIGN PATENT DOCUMENTS

| | | | |
|---|---|---|---|
| DE | 1200943 | B1 | 9/1965 |
| DE | 3341846 | A1 | 6/1984 |
| DE | 3341846 | A1 | 6/2004 |
| EP | 0647964 | A1 | 4/1995 |
| EP | 0647964 | B1 | 4/1995 |
| EP | 1170780 | A1 | 1/2002 |
| EP | 1170780 | B1 | 1/2002 |
| JP | 2002-56807 | | 2/2002 |
| JP | 2002056807 | A | 2/2002 |
| WO | 0000995 | A1 | 1/2000 |
| WO | 0000996 | A1 | 1/2000 |

OTHER PUBLICATIONS

Jurgen Mentel, et al: Experimental Investigation of Electrodes for High Pressure Discharge Lamps, IEEE vol. 5, Oct. 2000, pp. 3293-3300, XP010521754.

Written Opinion of the International Searching Authority PCT/IB2005/051241, Aug. 2005.

ISR, Internatioal Search Report PCT/IB2005051241, Aug. 2005.

* cited by examiner

*Primary Examiner* — Sikha Roy

(57) ABSTRACT

The invention relates to a method for the thermal treatment of tungsten electrodes having a fibrous mocrostructure and being free from thorium oxide for high-pressure discharge lamps, to such a tungsten electrode free from thorium oxide, to a method of manufacturing a high-pressure gas discharge lamp with at least one such tungsten electrode free from thorium oxide, to a high-pressure gas discharge lamp with at least one such tungsten electrode free from thorium oxide, and to a lighting unit with at least one such high-pressure gas discharge lamp.

11 Claims, No Drawings

METHOD FOR THE THERMAL TREATMENT OF TUNGSTEN ELECTRODES FREE FROM THORIUM OXIDE FOR HIGH-PRESSURE DISCHARGE LAMPS

The invention relates to a method for the thermal treatment of tungsten electrodes free from thorium oxide for high-pressure discharge lamps, to such a tungsten electrode free from thorium oxide, to a method of manufacturing a high-pressure gas discharge lamp with at least one such tungsten electrode free from thorium oxide, to a high-pressure gas discharge lamp with at least one such tungsten electrode free from thorium oxide, and to a lighting unit with at least one such high-pressure gas discharge lamp.

Gas discharge lamps with tungsten electrodes comprising thorium oxide have been used until now for automobile headlights. This doping leads inter alia to an increased recrystallization temperature of the electrodes. Said electrodes nevertheless tend to recrystallize, in dependence on their thermal pretreatment and the subsequent sealing process.

Usually, the tungsten electrodes are connected to the quartz material or the like in a sealing or pinching process in the manufacture of high-pressure discharge lamps, which may take place in several process steps in a usual manner. These process steps are often preceded by a thermal treatment, by means of which in particular impurities are removed from the surface of the electrodes in a usual manner.

Thorium oxide, however, has properties which render handling in the manufacturing process at least more difficult and which adversely affect the lamp characteristics. Thorium is radioactive and detrimental to the environment, so that handling of this material involves special measures and thus often a higher cost.

Recrystallized electrodes are mechanically very brittle. This leads to increased undesirable failures already in the manufacturing process of the lamp and subsequently during operation of the lamp, in particular under impact loads. In addition, such electrodes cause destructive cracks in the surrounding quartz material after sealing-in or the manufacture of the pinch. Destructive cracks are, for example, passages in this quartz material which extend in the quartz from the contact surface against the electrode up to the outer surface, thus leading to undesirable leaks in the lamp.

JP-2002056807 A discloses a tungsten anode for a short-arc lamp such as, for example, a xenon lamp, which comprises, besides the main ingredient of tungsten components of lanthanum, yttrium, and cerium, each of them in oxide form ($La_2O_3$, $Y_2O_3$, and $CeO_2$). The basic material of the anode may be pure tungsten or alternatively tungsten with aluminum, potassium, and silicon added thereto.

The material composition chosen for the anode, in particular the oxides of high melting point contained therein, serve to suppress a recrystallization of that portion of the tungsten anode that projects into the discharge space, i.e. is not closely surrounded by the pinch, during operation of the lamp. The object of this is to raise the recrystallization temperature, which is approximately 1600 to 1800° C. for usual anode materials, to approximately 1800 to 2000° C. for this anode. Lanthanum, yttrium, and cerium are scarce materials and expensive. The very high temperatures prevailing in the discharge space during the gas discharge render it impossible to prevent proportions of these rare materials from being freed and entering the discharge space, where they adversely affect the operation of the lamp.

It is an object of the invention to provide a tungsten electrode free from thorium oxide for a high-pressure discharge lamp which safeguards the operational reliability of the lamp in that a recrystallization of the electrode is prevented at least until operation of the lamp, where it is to be specified in what manner this tungsten electrode is made available.

A further aspect of the invention relates to a high-pressure discharge lamp with such a tungsten electrode according to the invention and its manufacture. The tungsten electrode according to the invention and the associated high-pressure discharge lamp with such a tungsten electrode, moreover, should be susceptible of industrial mass manufacture in a simple and effective manner.

The object of the invention is achieved by the characterizing features of claim 1.

The method for the thermal treatment of tungsten electrodes free from thorium oxide for high-pressure discharge lamps, according to the invention, is characterized in that the tungsten electrodes consist of pure tungsten or of tungsten doped with at least potassium, wherein said electrodes have a fibrous microstructure, and the maximum temperature during the thermal treatment is lower than the recrystallization temperature of the material of the tungsten electrodes. It is important here that this microstructure remains intact until the first operation of the lamp. It was surprisingly found that the microstructure obtaining until the first operation of the lamp has a major influence on the mechanical fragility of the electrode and on the tendency of the lamp to show destructive cracks in the seal or pinch, during manufacture and handling as well as during operation of the lamp.

No temperature lying above the recrystallization temperature of the tungsten electrodes according to the invention will usually be found in that portion of the tungsten electrode that is closely surrounded by the pinch, also during operation of the lamp. Tests have shown that a value of approximately 1400° C. is often not exceeded in this case. Indeed, this situation can be created in a simple manner by means of usual constructional adaptations.

The material choice according to the invention, which also includes observance of the relevant microstructure, and the process according to the invention followed during the method for the thermal treatment surprisingly achieve that additives such as thorium oxide, lanthanum oxide, yttrium oxide, and cerium oxide can be dispensed with. This is the more surprising as this problem has been known for a long time and such a simple solution has been in demand for an equally long time.

High-pressure discharge lamps in the sense of the present invention are in particular characterized in that they have a translucent lamp body which is closed in a vacuumtight manner, which contains an ionizable filling with in particular rare gas and metal halide, and in which tungsten electrodes are arranged which serve to ignite the gas mixture and to provide the electric current for the gas discharge during lamp operation. A high-pressure discharge lamp of this kind is known, for example, from the document DE 33 41 846 laid open to public inspection. As an example, xenon gas discharge lamps for motor vehicle headlights may be mentioned, but this is not to be regarded as restrictive in any sense.

The dependent claims relate to advantageous further embodiments of the invention.

It is preferred that the method, which is preferably carried out in an oxygen-free atmosphere at normal atmospheric pressure, comprises at least the following sequence of steps: heating from ambient temperature to the maximum processing temperature, keeping at the maximum processing temperature, and cooling down to room temperature. The method for the thermal treatment of tungsten electrodes free from thorium oxide for high-pressure discharge lamps is to be carried out in an oxygen-free atmosphere so as to prevent renewed impurities caused by oxidation. The process sequence, i.e. in particular the duration and the temperature profile, should be adapted to the nature and extent of the impurities to be removed in a usual manner.

It is furthermore preferred that the method is carried out in an atmosphere that contains hydrogen.

It is preferred for the material choice of the tungsten electrodes that the latter consist of tungsten doped with at most 500 ppm of potassium, at most 300 ppm of silicon, and at most 100 ppm of aluminum.

Said material of the tungsten electrodes, which has a recrystallization temperature of approximately 1800° C., is preferably heated to a processing temperature of at most approximately 1500° C.

The object of the invention is furthermore achieved in that the tungsten electrode free from thorium oxide is treated in a process as claimed in claims 1 to 5.

The object of the invention is furthermore achieved by means of a high-pressure gas discharge lamp with a tungsten electrode free from thorium oxide, wherein a portion of the tungsten electrode free from thorium oxide is enclosed by a seal or pinch, and the portion of the tungsten electrode free from thorium oxide enclosed by the seal or pinch has a fibrous microstructure.

A further object of the invention is achieved in that the method of manufacturing a high-pressure gas discharge lamp according to the invention, which has at least one such tungsten electrode free from thorium oxide, comprises at least a method for the thermal treatment of tungsten electrodes free from thorium oxide as claimed in claim 1.

Further particulars, features, and advantages of the invention will become apparent from the description of a preferred embodiment.

The material used for the tungsten electrodes is a potassium-doped tungsten (AKS-tungsten or so-termed non-sag tungsten). This material is characterized in that the potassium content is greater than 0 and smaller than 500 ppm, the silicon content greater than 0 and smaller than 300 ppm, and the aluminum content greater than 0 and smaller than 100 ppm. This material has a recrystallization temperature of approximately 1600° C. to 1800° C.

The method for the thermal treatment of tungsten electrodes free from thorium oxide for high-pressure discharge lamps, which is carried out in a hydrogen atmosphere at normal atmospheric pressure, comprises the following sequence of steps:

heating of the tungsten electrodes from room temperature to the maximum processing temperature (approximately 1500° C.), wherein approximately 600° C. is reached after 5 minutes and 1500° C. after a further 10 minutes, keeping at the maximum processing temperature for 30 minutes, and cooling down to room temperature within 90 minutes.

The thermal pre-treatment of the tungsten electrodes has been completed after a total of 105 minutes. The maximum temperature in the so-termed baking-out or degassing process is 1500° C., so that the most stable tungsten oxides can still be reliably removed, i.e. an optimum cleaning of the electrode surface takes place. A microstructure change (i.e. recrystallization) is avoided, so that the fibrous microstructure remains intact.

Any tungsten material may be used in principle for the electrode material, as long as the maximum temperature of the thermal treatment is adapted to the recrystallization temperature of the material in question, i.e. it must not exceed this temperature.

The invention claimed is:

1. A method for the thermal treatment of tungsten electrodes free from thorium oxide for high-pressure discharge lamps, characterized in that the tungsten electrodes consist of pure tungsten or of tungsten doped with at least potassium, wherein said electrodes have a fibrous microstructure, and the maximum temperature during the thermal treatment is lower than the recrystallization temperature of the material of the tungsten electrodes;

wherein the thermal treatment yields a cleaning of the electrode surface.

2. A method as claimed in claim 1, characterized in that the method, which is carried out in an oxygen-free atmosphere at normal atmospheric pressure, comprises at least the following sequence of steps: heating up from room temperature to the maximum processing temperature, keeping at the maximum processing temperature, and cooling down to room temperature.

3. A method as claimed in claim 2, characterized in that the method is carried out in an atmosphere that contains hydrogen.

4. A method as claimed in claim 1, characterized in that the tungsten electrodes consist of tungsten doped with at most 500 ppm of potassium, at most 300 ppm of silicon, and at most 100 ppm of aluminum.

5. A method as claimed in claim 1, characterized in that the recrystallization temperature of the material of the tungsten electrodes is approximately 1600° C. to 1800° C., and maximum processing temperature is approximately 1500° C.

6. A tungsten electrode free from thorium oxide and treated by a method as claimed in claim 1.

7. A method of manufacturing a high-pressure gas discharge lamp with at least one tungsten electrode free from thorium oxide, comprising at least a method for the thermal treatment of tungsten electrodes free from thorium oxide as claimed in claim 1.

8. A high-pressure gas discharge lamp with at least one tungsten electrode free from thorium oxide designed for automobile headlights and manufactured by a method as claimed in claim 7.

9. A high-pressure gas discharge lamp according to claim 1, wherein a portion of the tungsten electrode free from thorium oxide is enclosed by a seal or pinch, characterized in that the portion of the tungsten electrode free from thorium oxide enclosed by the seal or pinch has a fibrous microstructure.

10. A lighting unit comprising at least one high-pressure discharge lamp as claimed in claim 9.

11. A method for the thermal treatment of tungsten electrodes free from thorium oxide for high-pressure discharge lamps, characterized in that the tungsten electrodes consist of pure tungsten or of tungsten doped with at least potassium, wherein said electrodes have a fibrous microstructure, and the maximum temperature during the thermal treatment is lower than the recrystallization temperature of the material of the tungsten electrodes; and, wherein the fibrous microstructure remains intact until first operation.

* * * * *